US008955604B2

(12) United States Patent
Gette

(10) Patent No.: US 8,955,604 B2
(45) Date of Patent: Feb. 17, 2015

(54) RECEPTACLE SUB

(75) Inventor: Nicholas Peter Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 428 days.

(21) Appl. No.: 13/278,266

(22) Filed: Oct. 21, 2011

(65) Prior Publication Data

US 2013/0098635 A1 Apr. 25, 2013

(51) Int. Cl.

| | |
|---|---|
| ***E21B 23/01*** | (2006.01) |
| ***E21B 23/04*** | (2006.01) |
| ***E21B 34/14*** | (2006.01) |
| ***E21B 34/10*** | (2006.01) |
| *E21B 34/00* | (2006.01) |

(52) U.S. Cl.

CPC ..... *E21B 34/103* (2013.01); *E21B 34/14* (2013.01); *E21B 2034/007* (2013.01)

USPC ..... 166/382; 166/212; 166/332.4; 166/386

(58) Field of Classification Search

CPC .. E21B 34/14; E21B 2034/007; E21B 21/103

USPC ..... 166/382, 208, 386, 212, 116, 332.4, 166/334.1, 72

See application file for complete search history.

(56) References Cited

U.S. PATENT DOCUMENTS

| | | | | |
|---|---|---|---|---|
| 3,616,850 | A * | 11/1971 | Scott | 166/155 |
| 3,771,603 | A * | 11/1973 | Crowe | 166/375 |
| 4,574,894 | A * | 3/1986 | Jadwin | 175/317 |
| 4,915,175 | A * | 4/1990 | Mashaw, Jr. | 166/332.7 |
| 6,253,861 | B1 | 7/2001 | Carmichael et al. | |
| 7,628,213 | B2 * | 12/2009 | Telfer | 166/381 |
| 7,909,107 | B2 | 3/2011 | Gette | |
| 8,550,176 | B2 * | 10/2013 | Knobloch et al. | 166/386 |
| 2010/0270030 | A1 | 10/2010 | Ashy et al. | |
| 2011/0203809 | A1 * | 8/2011 | Knobloch et al. | 166/386 |
| 2013/0025877 | A1 * | 1/2013 | Robinson-Brown et al. | 166/373 |
| 2013/0098635 | A1 * | 4/2013 | Gette | 166/386 |
| 2013/0168099 | A1 * | 7/2013 | Themig | 166/308.1 |

FOREIGN PATENT DOCUMENTS

GB 2367844 A 4/2002

OTHER PUBLICATIONS

"Dart", http://www.glossary.oilfield.slb.com/en/Terms/d/dart.aspx, 2014.*

(Continued)

*Primary Examiner* — Jennifer H Gay

(74) *Attorney, Agent, or Firm* — Bracewell & Giuliani LLP

(57) ABSTRACT

A receptacle sub that increases the venting flowrate during retrieval of a running tool. The sub includes a sleeve with a bypass port in a central bore defined by a tubular body. The sleeve is selectively moveable from an upper position to a lower position. A seal on the sleeve seals the sleeve to the bore while a retainer holds the sleeve in the upper position. A bypass passage in the body is in fluid communication with the bypass port. A drop member lands on the sleeve, blocking downward flow through the sleeve and actuating a hydraulic function. The drop member receives a fluid pressure greater than the hydraulic function fluid pressure, releasing the retainer to move the sleeve to the lower position. This allows fluid communication from above the central bore through the bypass passage and through the bypass ports of the sleeve below the drop member.

16 Claims, 7 Drawing Sheets

(56) References Cited

OTHER PUBLICATIONS

Search Report dated Dec. 19, 2012 from corresponding Application No. GB 1218717.5.

Layout/SSWE A610716-192, Sep. 30, 2008.

SSWE/Assembly A953380-1, May 30, 2001.

Assembly/SSWE A953380-2, Jan. 26, 2009.

* cited by examiner

RECEPTACLE SUB

BACKGROUND OF THE INVENTION

1. Field of the Invention

This invention relates in general to drop balls, plugs, or darts used to operate running well tool functions and, in particular, to a bypass sleeve with a dart landing shoulder to variably allow fluid flow past the drop member following tool operation.

2. Brief Description of Related Art

Darts, drop balls, or plugs are often used to actuate hydraulic devices within a wellhead or wellbore during well drilling and completion. Typically, a running tool is run to a predetermined location in a wellhead. A drop ball is then dropped into the running string supporting the running tool and pumped down to land at a shoulder within or axially below the running tool. Fluid pressure behind the drop ball is then increased until the fluid pressure reaches a level sufficient to actuate the hydraulic functionality of the running tool. The running tool may then be retrieved from the wellbore. This may be accomplished in a wet retrieval process. In a wet retrieval process, the running tool is pulled without first removing the column of fluid resting on the drop ball. This requires a tremendous expenditure of energy, and due to the significant weight of water being pulled, it is incredibly time consuming. In addition, the amount of water introduced into the deck level of the drilling rig can cause a significant safety problem to operators and workers located on the working deck.

Some devices may be pulled in a dry retrieval process. These devices include fluid ports that allow communication from the central passageway of the running tool to the wellbore. The fluid ports remain open during the operation of the running tool; thus, the fluid ports must be small enough to allow fluid pressure to build up behind the ball or dart despite the open fluid communication between the central passage of the running tool and the wellbore. When the device is retrieved, the fluid behind the dart will flow through the fluid ports into the wellbore. This eliminates the safety risk of the wet retrieval process by allowing the column of fluid blocked by the dart to drain past the dart during retrieval. However, this dry retrieval process is still incredibly time consuming as the process must be conducted slowly enough to allow the fluid to drain through the fluid ports without needlessly introducing fluid onto the platform deck.

One attempt to overcome this problem has been to include a burst disc in the dart to allow for faster draining of the drill string. However, because the burst disc must fit within the dart, it is, by necessity, smaller than the diameter of the fluid column above it. Therefore, while it does provide a faster drainage process than the previously described fluid ports, the burst disc still restricts flow and cannot maintain a large enough flowrate to drain as fast as the drill string can be pulled. Thus, there is a need for an apparatus to allow for a dry retrieval process that will decrease the time to retrieve the running tool, thereby decreasing the rig time needed and the cost associated with operation of the rig.

SUMMARY OF THE INVENTION

These and other problems are generally solved or circumvented, and technical advantages are generally achieved, by preferred embodiments of the present invention that provide a receptacle sub, and a method for using the same.

In accordance with an embodiment of the present invention, a well tool is disclosed. The well tool includes a tubular body adapted to be connected to and lowered on a running tool string into a well conduit. The tubular body defines a central bore having an axis. The well tool also includes a sleeve in the central bore that is selectively moveable from an upper position to a lower position. The sleeve has at least one bypass port extending from an exterior to an interior of the sleeve. At least one retainer secures the sleeve in the upper position relative to the tubular body. The well tool includes a seal on the sleeve that seals the exterior of the sleeve to the bore while the sleeve is in the upper position, and a bypass passage in the body having an upper inlet portion and a lower outlet portion in fluid communication with the bypass ports. The well tool includes a drop member adapted to be lowered through the running tool string and to land on the sleeve. The drop member is adapted to be lowered through the running tool string and land on the sleeve. When the drop member is located in the sleeve, and the sleeve is in the upper position, the inlet portion of the bypass passage is blocked from fluid communication with the central bore. The retainer is adapted to selectively release the sleeve so that the sleeve moves downward to the lower position. When the sleeve is in the lower position, the bypass passage is in fluid communication with the bore and allows fluid communication from above the central bore through the bypass passage via the bypass ports of the sleeve.

In accordance with another embodiment of the present invention, a well tool assembly is disclosed. The well tool assembly includes a running tool adapted to be coupled to a running string and having at least one hydraulically actuated function. The assembly further includes a receptacle sub coupled to a lower end of the running tool so that when a drop member is landed in the receptacle sub, fluid flow through the receptacle sub is blocked and the hydraulically actuated function will actuate. The receptacle sub has a bypass passage that is opened in response to increased fluid pressure after the function is performed, the bypass passage extends below the drop member and has a cross-sectional flow area that is at least equal to a flow area cross section through a central passage of the running tool.

In accordance with yet another embodiment of the present invention, a method for operating a running tool is disclosed. The method begins by providing a well tool assembly. The well tool assembly includes a running tool adapted to be coupled to a running string and having at least one hydraulically actuated function, and a receptacle sub coupled to a lower end of the running tool. The method continues by dropping a drop member in the running string to land in the receptacle sub in an upper position, thereby blocking fluid flow through the receptacle sub. The method continues by supplying fluid pressure to the running tool at a first pressure to actuate the running tool to perform a function. Then, the method supplies fluid pressure to the running tool at a second pressure, greater than the first pressure, to drive the receptacle sub to a lower position, thereby opening a fluid flow bypass around the drop member.

In still another embodiment of the present invention, a system for setting an annular seal between a casing hanger and a wellhead is disclosed. The system includes a running tool and a receptacle sub. The running tool is adapted to be coupled to a running string and carries an annular seal for disposal between the casing hanger and the wellhead. The receptacle sub is coupled to a lower end of the running tool so that when a drop member is landed in the receptacle sub, fluid flow through the receptacle sub is blocked. The annular seal will energize in response to a resulting increased fluid pressure caused by the blocked receptacle sub, thereby sealing an annulus between the wellhead and the casing hanger. The receptacle sub includes a bypass passage that is opened in response to increased fluid pressure after the seal is energized. The bypass passage extends below the drop member and has a cross-sectional flow area that is at least equal to a flow area cross section through a central passage of the running tool so that the running tool may be pulled to the surface.

An advantage of a preferred embodiment is that it provides an apparatus for the actuation of a hydraulically actuated running tool with a dart or drop ball. The running tool may then drain the column of fluid blocked by the dart or drop ball at an increased rate to speed the process of running tool retrieval following tool actuation. This reduces the rig time needed to drill and complete the well.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, casing hanger landing and setting, and the like have been omitted inasmuch as such details are not considered necessary to obtain a complete understanding of the present invention, and are considered to be within the skills of persons skilled in the relevant art.

Figure 1:
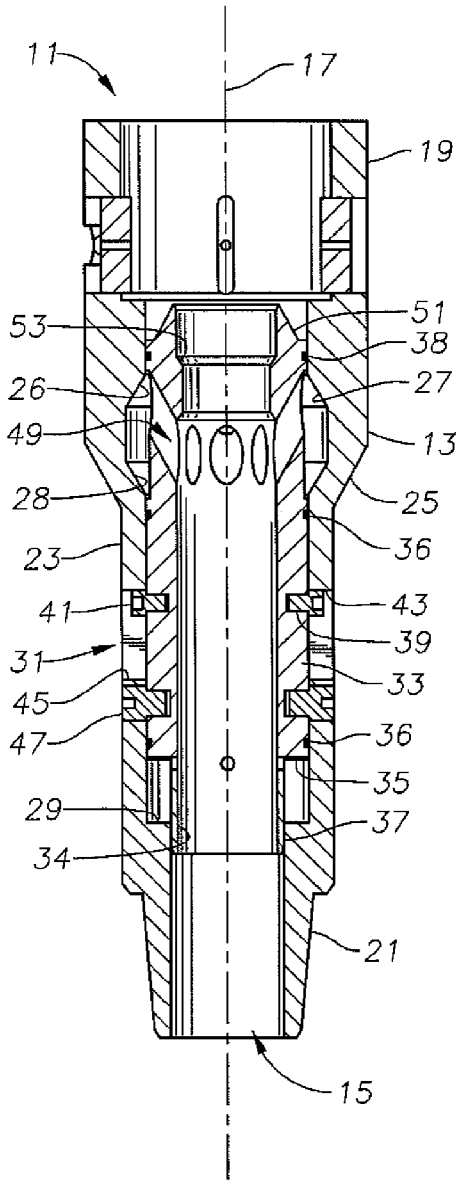
FIG. 1 is sectional view of a receptacle sub in accordance with an embodiment of the present invention.

Referring to FIG. 1, a receptacle sub 11 includes a tubular sub body 13. Tubular sub body 13 defines a central bore 15 for the passage of fluids. Central bore 15 has an axis 17. Tubular sub body 13 also has an upper end 19 adapted to couple to a running tool (FIG. 4), and a lower end 21 adapted to couple to a tubing string (not shown) such as by a threaded coupling connection. A person skilled in the art will understand that any suitable means may be used to couple lower end 21 to the tubing string. In the illustrated embodiment, upper end 19 has an exterior diameter greater than an exterior diameter of a main body 23 of tubular sub body 13. A taper 25 transitions the exterior diameter of upper end 19 to the exterior diameter of main body 23.

Central bore 15 further defines a bypass passage 27 and an upward facing shoulder 29. In the illustrated embodiment, bypass passage 27 may be an annular recess formed in central bore 15. A person skilled in the art will understand that bypass passage 27 may be any suitable fluid flow passage or passages and may comprise one or more separate passages. Bypass passage 27 is proximate to upper end 19 within central bore 15, and upward facing shoulder 29 is proximate to lower end 21 within central bore 15. Bypass passage 27 includes an upper inlet portion 26 and a lower inlet portion 28. Main body 23 includes a plurality of windows 31 extending from the exterior surface of main body 23 into central bore 15.

A bypass sleeve 33 is disposed within central bore 15. Bypass sleeve 33 has an exterior diameter slightly smaller than central bore 15 such that bypass sleeve 33 may move axially within central bore 15. Bypass sleeve 33 also defines a sleeve bore 34. Bypass sleeve 33 includes an annular downward facing shoulder 35 on an exterior diameter portion of bypass sleeve 33. Downward facing shoulder 35 extends from the exterior diameter surface of bypass sleeve 33 to a cylindrical protrusion 37. Cylindrical protrusion 37 extends axially downward from a lower portion of bypass sleeve 33 into close engagement with the lower portion of central bore 15. Bypass sleeve 33 includes upper and lower seals 36. Upper and lower seals 36 are located axially above and below windows 31 such that bypass sleeve 33 will seal central bore 15 to prevent flow of fluid through windows 31. As bypass sleeve 33 moves through central bore 15 from an upper position (FIG. 1) to a lower position (FIG. 3), upper and lower seals 36 will maintain sealing engagement with central bore 15.

Figure 3:
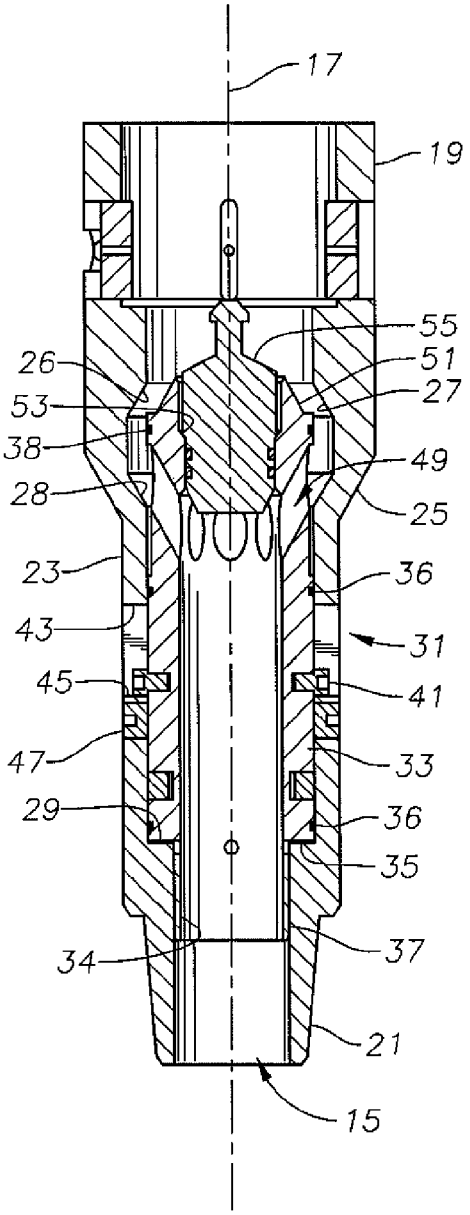
FIG. 3 is a sectional view of the receptacle sub of FIG. 1 during draining of a drill string above the receptacle sub.

In the illustrated embodiment, bypass sleeve 33 includes a plurality of threaded bore holes 39. At least one threaded bore hole 39 corresponds with each window 31. A limiter screw 41, is threaded into each threaded bore hole 39 through window 31. When fully threaded into bore hole 39, a head of each limiter screw 41 will protrude into window 31. As bypass sleeve 33 moves axially within central bore 15, the heads of each limiter screw 41 will move through window 31, restraining movement of bypass sleeve 33 as the head of limiter screws 41 contact downward facing shoulder 43 of window 31 as shown in FIG. 1, and upward facing shoulder 45 of window 31 as shown in FIG. 3. Limiter screws 41 may also provide a visual indication of the location of bypass sleeve 33 within main body 23. A person skilled in the art will understand that limiter screws 41 may comprise any suitable object that may provide a reactive force to limit axial movement of bypass sleeve 33 as described in more detail below. The stop limiters may comprise screws, pins, protrusions formed in bypass sleeve 33, and the like. Similarly, windows 31 may comprise any suitable stop receptacle and have any suitable configuration such that a corresponding stop limiter my interact with the stop receptacle to limit axial movement of bypass sleeve 33.

A shown in FIG. 1, cylindrical protrusion 37 has a length such that cylindrical protrusion 37 will extend past upward facing shoulder 29 of main body 23 when bypass sleeve 33 is in a position of maximum upward movement. In this manner, cylindrical protrusion 37 provides a mechanism to prevent landing of drop members, such as drop balls, darts, or plugs, on upward facing shoulder 29. This will prevent unintentional blockage of central bore 15 and sleeve bore 34 prior to landing of a drop member in bypass sleeve 33 as described in more detail below. Preferably, a wall of cylindrical protrusion 37 is as thin as possible to maintain the maximum size of sleeve bore 34.

A plurality of retainers, such as shear pins 47, will extend through bores in the sidewall of main body 23 of tubular sub body 13. The retainers may comprise any device suitable for preventing movement of bypass sleeve 33 relative to tubular sub body 13 prior to actuation of a corresponding running tool. For example, retainers may be shear pins 47, shear screws, a split ring retainer, or the like. Shear pins 47 will protrude into corresponding bores in an exterior diameter surface of bypass sleeve 33, thereby preventing axial movement of bypass sleeve 33 relative to main body 23 prior to shearing of shear pins 47. In the illustrated embodiment, each shear pin 47 has a shear rating of 1,000 psi, and receptacle sub 11 may include one to twelve shear pins 47. In this manner, receptacle sub 11 may be configured to operate at relatively low pressures, as little as 1,000 psi, to relatively high pressures, as high as 12,000 psi. A person skilled in the art will understand that shear pins of different strength ratings and of different numbers may be used to adapt receptacle sub 11 to any desired pressure of operation.

Referring to FIG. 1, an upper end of bypass sleeve 33 defines a plurality of bypass sleeve ports 49. Bypass sleeve ports 49 extend from a first position on the exterior surface of bypass sleeve 33 to a second position on sleeve bore 34 axially beneath the first position such that bypass sleeve ports 49 extend axially downward at an angle from the exterior of bypass sleeve 33 to sleeve bore 34. When in the upper position as shown in FIG. 1, upper surfaces of bypass sleeve ports 49 on the exterior diameter surface of bypass sleeve 33 correspond with an upper inlet portion 26 of bypass passage 27, blocking flow through bypass passage 27. When in the lower position as shown in FIG. 3, a lower surface of each bypass opening 49 will coincide with lower inlet portion 28 of bypass passage 27 such that fluid may flow unobstructed from bypass passage 27 into bypass sleeve ports 49. A person skilled in the art will understand that bypass sleeve ports 49 may provide alternative flow paths and arrangements, such as horizontal flow paths.

As shown in FIG. 1, an upper end of bypass sleeve 33 includes a taper 51 from an exterior diameter surface of bypass sleeve 33 to sleeve bore 34 at the upper end of bypass sleeve 33. Bypass sleeve 33 includes a seal 38 interposed between the exterior diameter surface of bypass sleeve 33 and central bore 15 axially above bypass passages 27. When bypass sleeve 33 is in the maximum upward axial position shown in FIG. 1, the upper end of bypass sleeve 33 will block bypass passage 27, and seal 38 will prevent flow of fluid between bypass sleeve 33, central bore 15, and through bypass passage 27, thereby maintaining all fluid flow through sleeve bore 34. As shown in FIG. 3, when bypass sleeve 33 is the maximum downward axial position, seal 38 is within bypass passage 27. Thus, seal 38 will allow flow from above bypass sleeve 33 into bypass passage 27, allowing fluid to flow from central bore 15 through bypass passage 27 and into sleeve bore 34. Taper 51 provides a greater flow area from above bypass sleeve 33 into bypass passage 27 when bypass sleeve 33 is in the lower position of FIG. 3.

Central bore 34 defines a dart shoulder 53 proximate to the upper end of bypass sleeve 33. Dart shoulder 53 may be an upward facing shoulder axially above bypass sleeve ports 49, as shown. Preferably, a drop member (such as a dart 55 of FIG. 2, a drop ball, a plug, or the like) may land on dart shoulder 53, blocking sleeve bore 34 while not inhibiting fluid flow through bypass ports 49.

Figure 2:
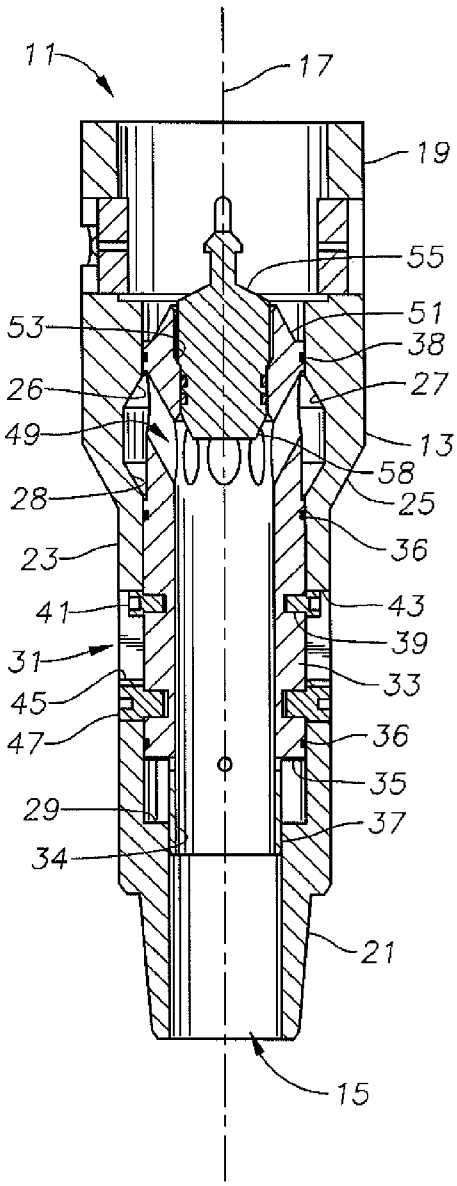
FIG. 2 is a sectional view of the receptacle sub of FIG. 1 with a dart in place within the receptacle sub.

Referring now to FIG. 2, dart 55 is shown in place within bypass sleeve 33 after landing on dart shoulder 53. As illustrated, dart 55 may have a tapered lower end 58. Tapered lower end 58 will coincide with the angle of the upper surface of bypass ports 49 so as to not obstruct flow from opening 49 into bypass sleeve 33. After landing of dart 55, fluid will be pumped down a running string (not shown) axially above receptacle sub 11. Dart 55 will prevent passage of the fluid down sleeve bore 34, thus as fluid continues to pump into the tubing string, the pumping will increase the pressure on shear pins 47 maintaining the axial position of bypass sleeve 33 relative to main body 23. Once a predetermined pressure is reached, shear pins 47 will shear, as shown in FIG. 3. Bypass sleeve 33 will then move axially downward to the position shown. The heads of limiter screws 41 will contact upward facing shoulders 45 of windows 31, and downward facing shoulder 35 may land on and abut upward facing shoulder 29. When bypass sleeve 33 reaches the maximum downward axial position shown in FIG. 3, fluid axially above dart 55 will then flow through bypass passage 27 and into central bore 34.

Figure 4:
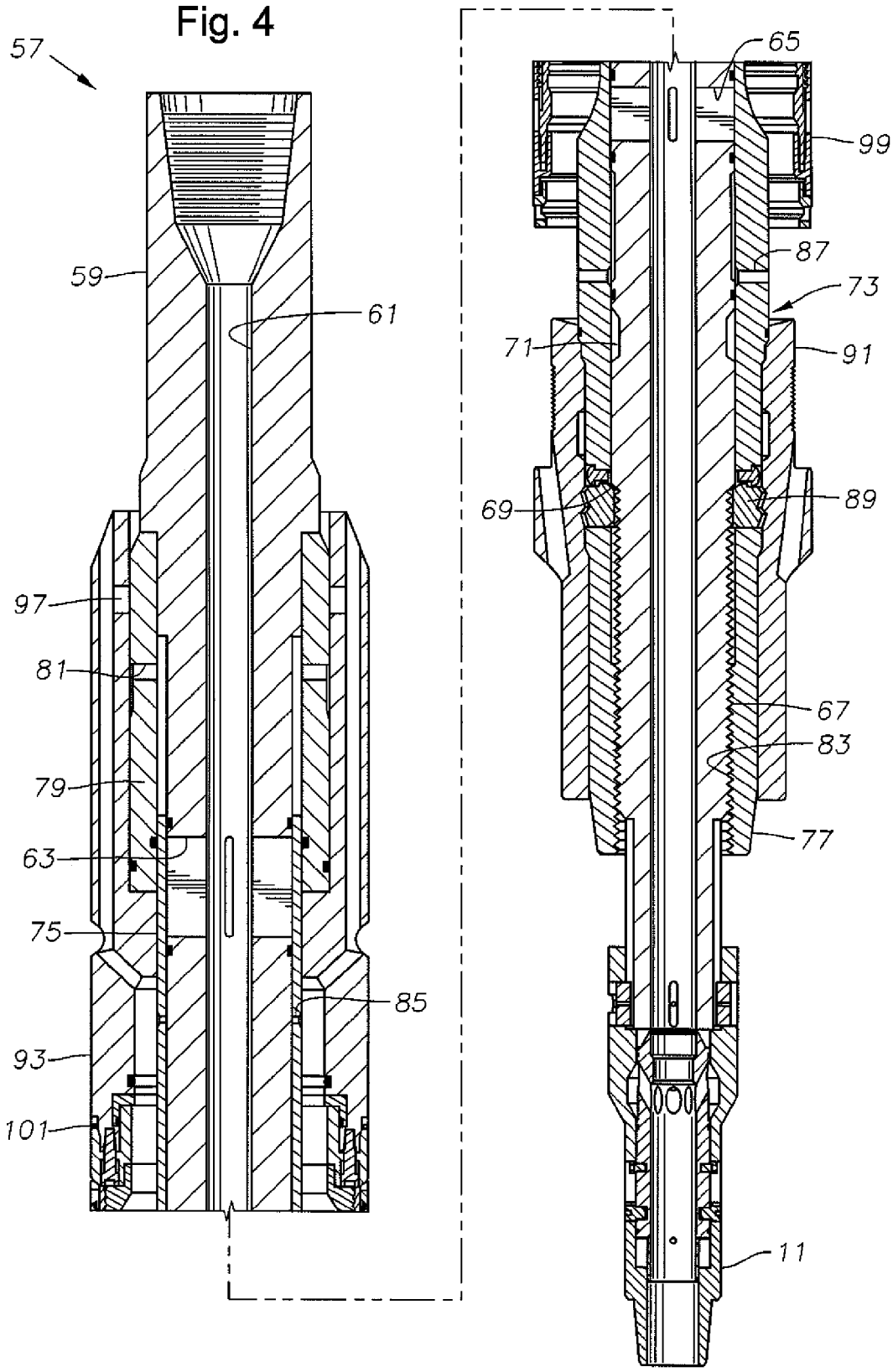
FIG. 4 is a sectional view of a high capacity running tool constructed with a piston cocked, an engagement element retracted, and the receptacle sub of FIG. 1 coupled to a lower end.

Referring to FIG. 4, there is generally shown an embodiment for a high capacity running tool 57 that is used to set and internally test a casing hanger packoff. High capacity running tool 57 is comprised of a stem 59. Stem 59 is a tubular member with an axial passage 61 extending therethrough. Stem 59 connects on its upper end to a string of drill pipe (not shown). Stem 59 has an upper stem port 63 and a lower stem port 65 positioned in and extending therethrough that allow fluid communication between the exterior and axial passage of stem 59. A lower portion of stem 59 has threads 67 in its outer surface. The outer diameter of an upper portion of stem 59 is greater than the outer diameter of the lower portion of stem 59 containing threads 67. As such, a downward facing shoulder 69 is positioned adjacent threads 67. A recessed pocket 71 is positioned in the outer surface of stem 59 at a select distance above downward facing shoulder 69.

High capacity running tool 57 has a body 73 that surrounds stem 59, as stem 59 extends axially through body 73. Body 73 has an upper body portion 75 and a lower body portion 77. Upper portion 75 of body 73 is a thin sleeve located between an outer sleeve 79 and stem 59. Outer sleeve 79 is rigidly attached to stem 59. A latch device (not shown) is housed in a slot 81 located within outer sleeve 79. Lower body portion 77 of body 73 has threads 83 along its inner surface that are engaged with threads 67 on the outer surface of stem 59. Body 73 has an upper; body port 85 and a lower body port 87 positioned in and extending therethrough that allow fluid communication between the exterior and interior of the stem body 73. Lower body portion 77 of body 73 houses an engaging element 89. In this particular embodiment, engaging element 89 is a set of dogs having a smooth inner surface and a contoured outer surface. The contoured outer surface is adapted to engage a complimentary contoured surface on the inner surface of a casing hanger 91 when engaging element 89 is engaged with casing hanger 91. Although not shown, a string of casing is attached to the lower end of casing hanger 91. The inner surface of engaging element 89 is initially in contact with threads 67 on the inner surface of stem 59.

Figure 6:
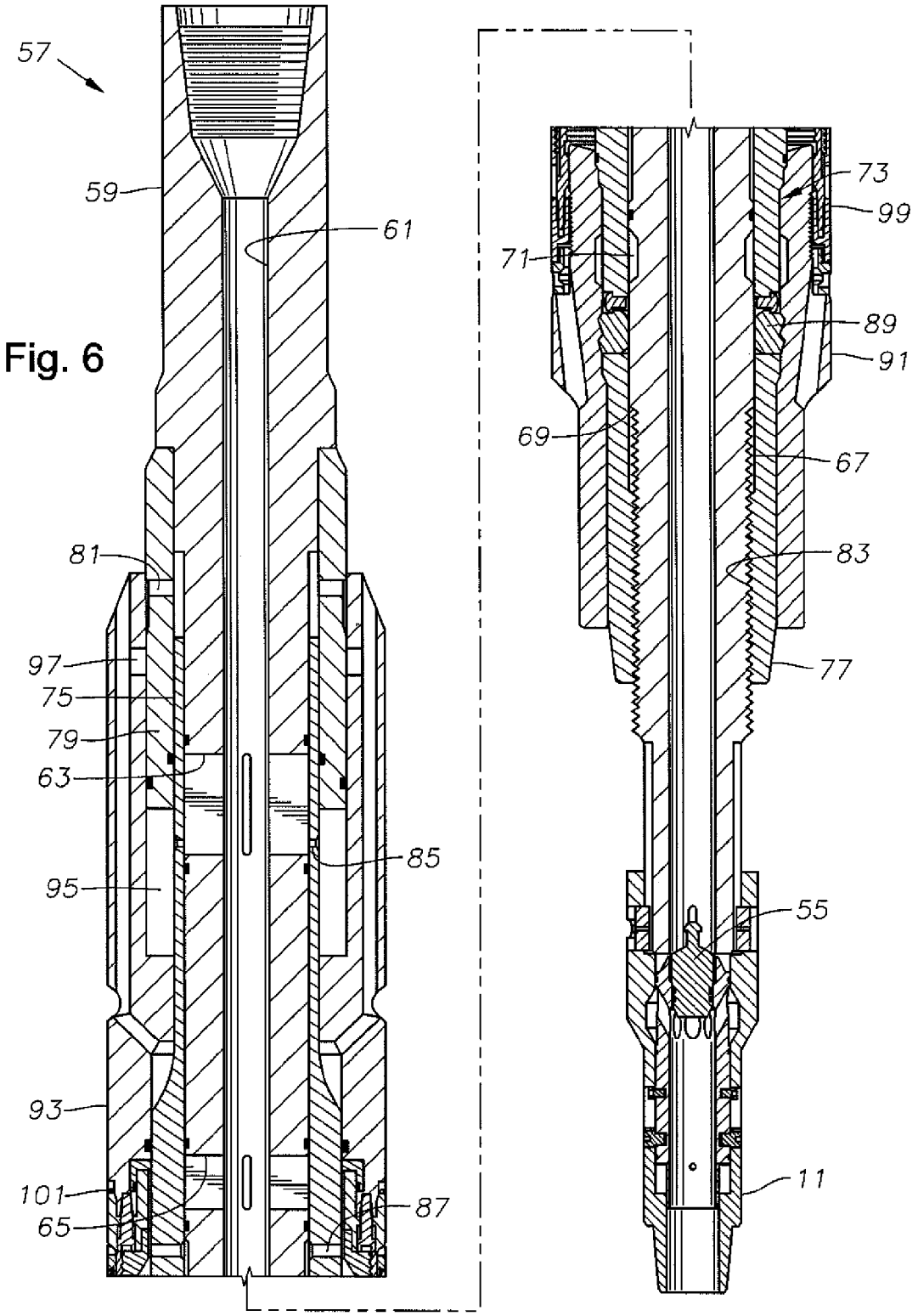
FIG. 6 is a sectional view of the high capacity running tool of FIG. 4 in a setting position.

A piston 93 surrounds stem 59 and substantial portions of body 73. Referring to FIG. 6, a piston chamber 95 is formed between upper body portion 75, outer sleeve 79, and piston 93. Piston 93 is initially in an upper or "cocked" position relative to stem 59, meaning that the area of piston chamber 95 is at its smallest possible value, allowing for piston 93 to be driven downward. A piston locking ring 97 extends around the outer peripheries of the inner surface of piston 93. Piston locking ring 97 works in conjunction with the latch device (not shown) contained within outer sleeve slot 81 to restrict movement of the piston during certain running tool functions. A casing hanger packoff seal 99 is carried by piston 93 and is positioned along the lower end portion of piston 93. Casing hanger packoff seal 99 will act to seal casing hanger 91 to the wellbore (not shown) when properly set. While piston 93 is in the upper or "cocked" position, casing hanger packoff seal 99 is spaced above casing hanger 91.

Receptacle sub 11 is connected to the lower end of stem 59. Receptacle sub 11 will operate as described above with respect to FIGS. 1-3. When dart 55 lands within receptacle sub 11, it will act as a seal, effectively sealing the lower end of stem 59.

Referring to FIG. 4, in operation, high capacity running tool 57 is initially positioned such that it extends axially through a casing hanger 91. Piston 93 is in a "cocked" position, and the stem ports 63, 65 and body ports 85, 87 are axially offset from one another. Casing hanger packoff seal 99 is carried by piston 93. High capacity running tool 57 is lowered into casing hanger 91 until the outer surface of body 73 of high capacity running tool 57 slidingly engages the inner surface of casing hanger 91.

Figure 5:
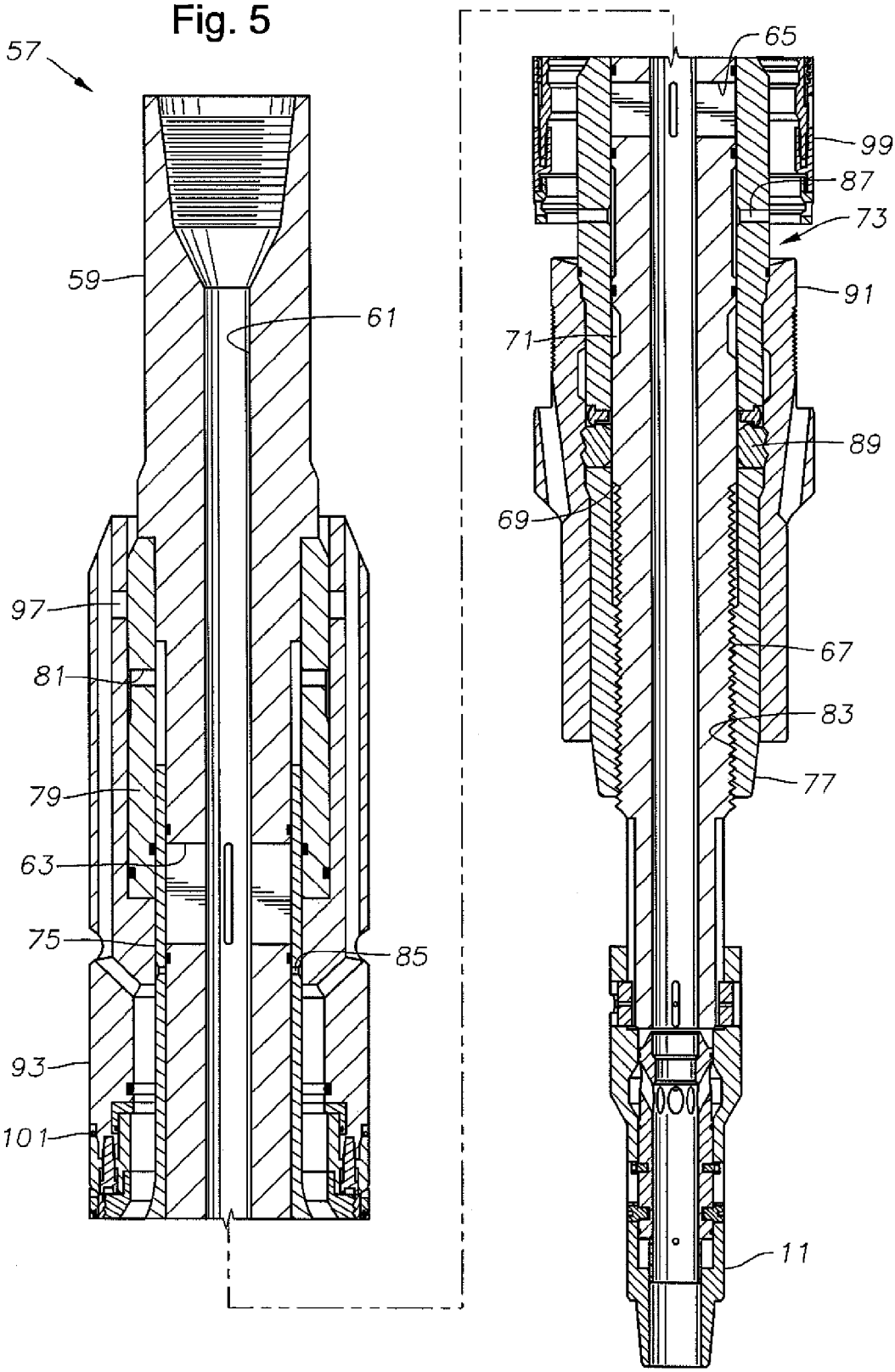
FIG. 5 is a sectional view of the high capacity running tool of FIG. 4 in a running position with the engagement element engaged.

Referring to FIG. 5, once high capacity running tool 57 and casing hanger 91 are in abutting contact with one another, stem 59 is rotated four revolutions. As stem 59 is rotated relative to body 73, stem 59 and piston 93 move longitudinally downward relative to body 73. As stem 59 moves longitudinally, shoulder 69 on the outer surface of stem 59 makes contact with engaging element 89, forcing it radially outward and in engaging contact with the inner surface of casing hanger 91, thereby locking body 73 to casing hanger 91. As stem 59 moves longitudinally, stem ports 63, 65 and body ports 85, 87 also move relative to one another.

Referring to FIG. 6, once high capacity running tool 57 and casing hanger 91 are locked to one another, high capacity running tool 57 and casing hanger 91 are lowered down the riser into the subsea wellhead housing (not shown) until casing hanger 91 comes to rest. Referring to FIG. 6, a dart 55 is then dropped or lowered into axial passage 61 of stem 59. Dart 55 lands in receptacle sub 11, thereby sealing the lower end of stem 59. Stem 59 is then rotated four additional revolutions in the same direction. As stem 59 is rotated relative to body 73, stem 59 and piston 93 move further longitudinally downward relative to body 73 and casing hanger 91. As stem 59 moves longitudinally, stem ports 63, 65 and body ports 85, 87 also move relative to one another. Upper stem port 63 aligns with upper body port 85, but lower stem port 65 is still positioned above lower body port 87. This position allows fluid communication from axial passage 61 of stem 59, through stem 59, into and through body 73, and into piston 93. Fluid pressure is applied down the drill pipe and travels through axial passage 61 of stem 59 before passing through upper stem port 63, upper body port 85, and into chamber 95, driving piston 93 downward relative to stem 59. As piston 93 moves downward, the movement of piston 93 sets the casing hanger packoff seal 99 between an outer portion of casing hanger 91 and the inner diameter of the subsea wellhead housing.

Figure 7:
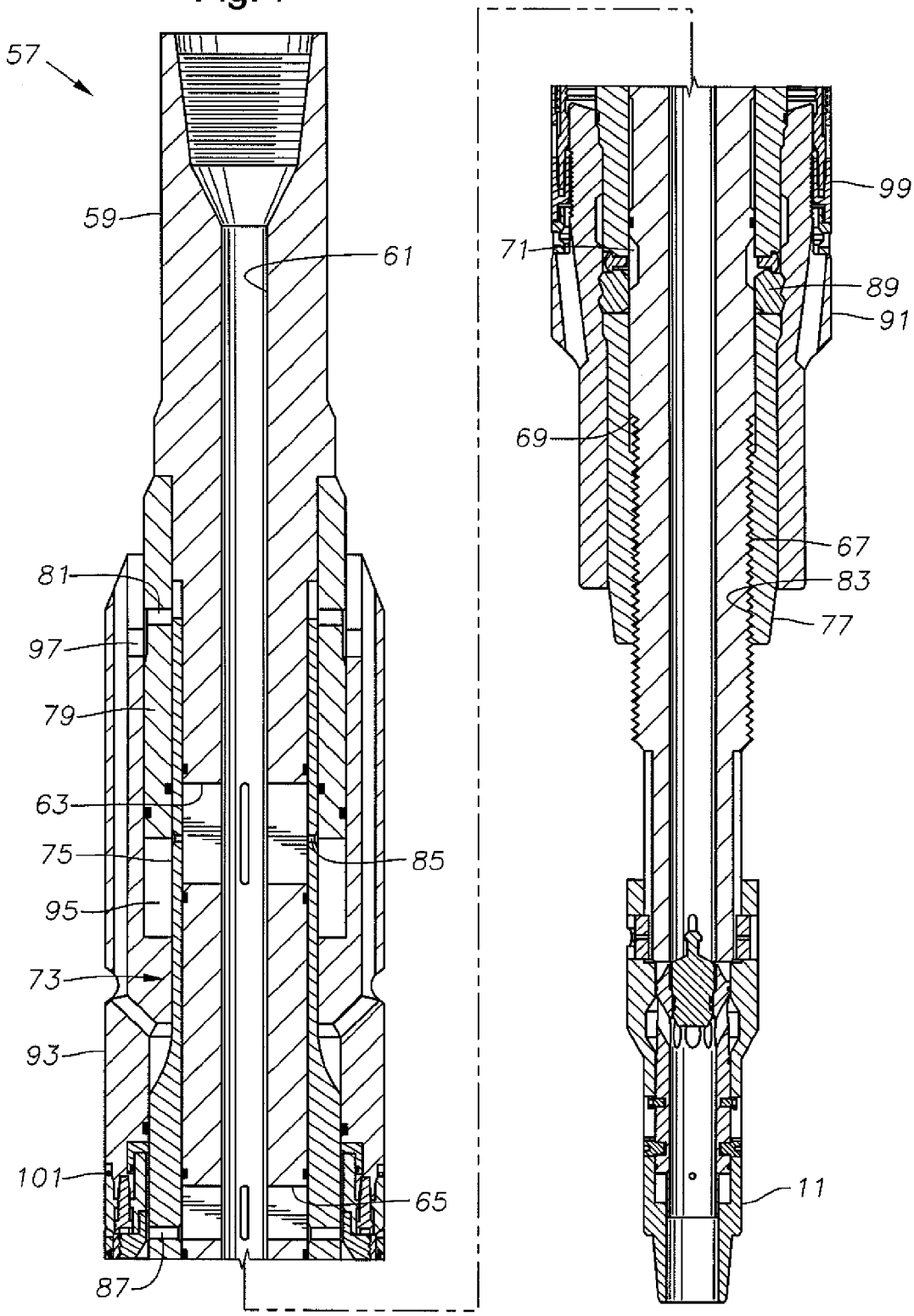
FIG. 7 is a sectional view of the high capacity running tool of FIG. 4 in a seal testing position.

Referring to FIG. 7, once piston 93 is driven downward and casing hanger packoff seal 99 is set, stem 59 is then rotated four additional revolutions in the same direction. As stem 59 is rotated relative to body 73, stem 59 moves further longitudinally downward relative to body 73 and casing hanger 91. Stem 59 also moves downward at this point relative to piston 93. As stem 59 moves longitudinally, stem ports 63, 65 and body ports 85, 87 also move relative to one another. Lower stem port 65 aligns with lower body port 87, allowing fluid communication from axial passage 61 of stem 59, through stem 59, into and through body 73, and into an isolated volume above casing hanger packoff seal 99. Upper stem port 63 is still aligned with upper body port 85. The latch device located with slot 81 on outer sleeve 79 is activated by the movement of stem 59 and will act in conjunction with piston locking ring 97 to restrict the upward movement of piston 93 beyond the latch device. Pressure is applied down the drill pipe and travels through axial passage 61 of stem 59 before passing through lower stem port 63, lower body port 85, and into an isolated volume above casing hanger packoff seal 99, thereby testing casing hanger packoff seal 99. The same pressure is applied to piston 93, creating an upward force, however, movement of piston 93 in an upward direction is restricted by the engagement of piston locking ring 97 and the latch device (not shown) positioned in slot 81 on outer sleeve 79. In an alternate embodiment, the size of the fluid chambers in piston 93 and seal 99 areas could be sized such that the larger sized fluid chamber in seal 99 area maintains a downward force on piston 93, thereby eliminating the need for the latch device and piston locking ring 97. An elastomeric seal 101 is mounted to the exterior of piston 93 for sealing against the inner diameter of the wellhead housing. Seal 101 defines the isolated volume above casing hanger packoff seal 99. If casing hanger packoff seal 99 is not properly set, a drop in fluid pressure held in the drill pipe will be observed as the fluid passes through the seal area.

Figure 8:
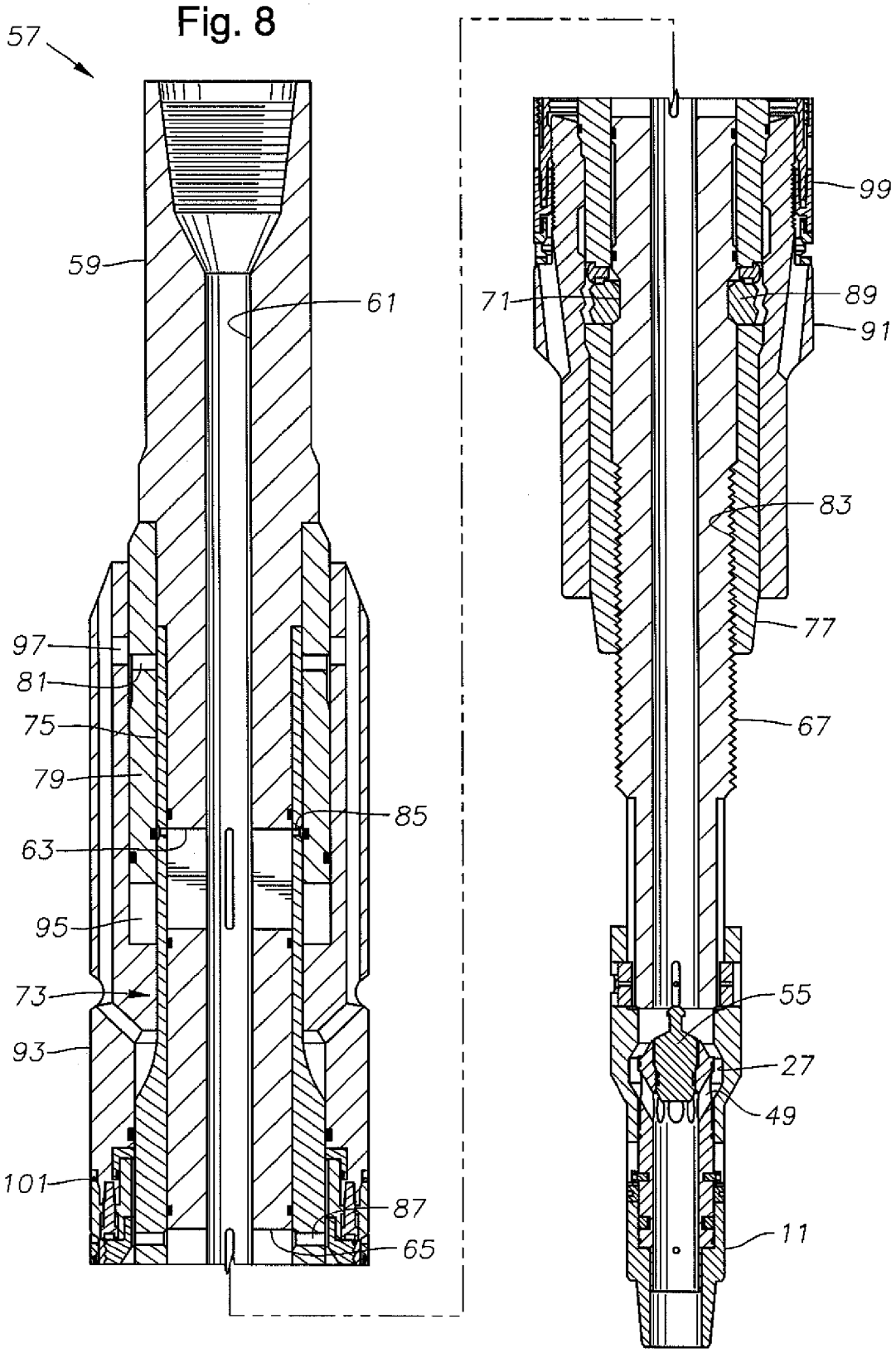
FIG. 8 is a sectional view of the high capacity running tool of FIG. 4 in an unlocked position with the engagement element disengaged.

Referring to FIG. 8, once the casing hanger packoff seal 99 has been tested, stem 59 is then rotated four additional revolutions in the same direction. As stem 59 is rotated relative to body 73, stem 59 moves further longitudinally downward relative to body 73, casing hanger 91, and piston 93. As stem 59 moves longitudinally downward, the engaging element 89 is freed and moves radially inward into recessed pocket 71 on the outer surface of stem 59, thereby unlocking body 73 from casing hanger 91. Upper stem port 63 remains aligned with upper body port 85. Lower stem port 65 may remain aligned with lower body port 87. Lower stem port 65 and lower body port 87 may partially vent the column of fluid in the drill pipe.

As described above with respect to FIG. 3, fluid pressure will be increased 15% to 20% more than needed to test casing hanger 91. In so doing, shear pins 47 will shear, causing bypass sleeve 33 to move axially downward from the upper position shown in FIG. 1 to the lower position shown in FIG. 3 and FIG. 8. Fluid above dart 55 will then flow through bypass passage 27 and bypass sleeve ports 49. In the illustrated embodiment, bypass ports 49 are of a sufficient size and shape such that the flow through bypass ports 49 is greater than the flow through the cross-sectional area of the drill string. This allows fluid to flow unrestricted past dart 55 for dry retrieval of running tool 57 or pressure access to a stinger or other device axially below receptacle sub 11.

Figure 9:
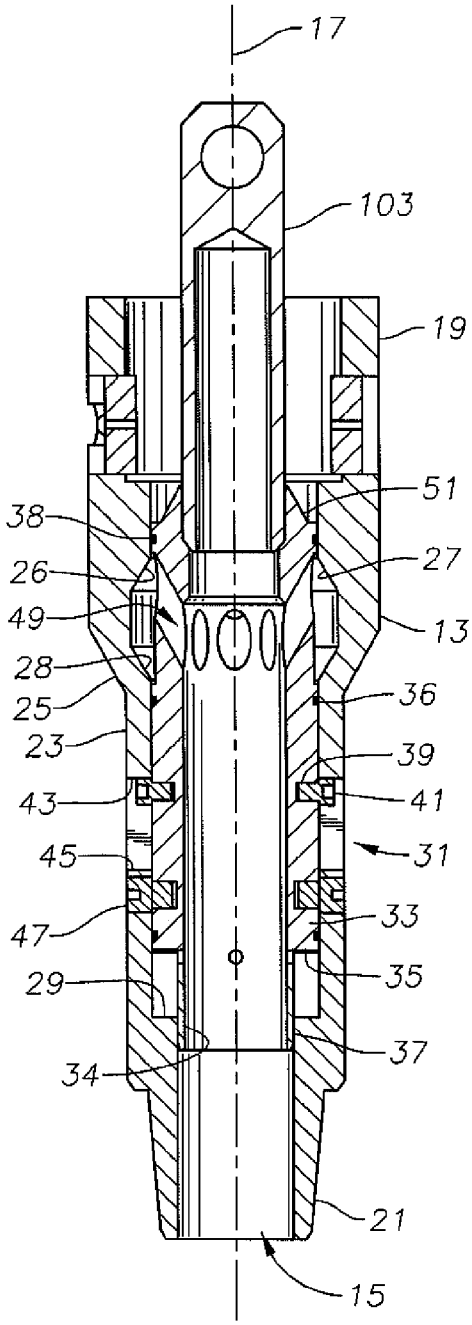
FIG. 9 is a sectional view of the receptacle sub of FIG. 1 being re-cocked for reuse.

Referring to FIG. 9, receptacle sub 11 is shown after actuation and removal from a well. Dart 55 has been removed from its landing location on dart shoulder 53, clearing sleeve bore 34. A re-cocking tool 103 may then be coupled to bypass sleeve 33 and used to reposition bypass sleeve 33 into the position of FIG. 1. As shown in FIG. 4, receptacle sub 11 may then be refitted with additional shear pins 47 and reattached to a running tool, such as running tool 57, for repeated use.

Accordingly, the disclosed embodiments provide numerous advantages. For example, the disclosed embodiments provide an apparatus for the actuation of a hydraulically actuated running tool using a dart or drop ball. The apparatus then allows for a dry retrieval that drains the column of fluid blocked by the dart or ball at an increased rate to speed the process of running tool retrieval. This significantly reduces the rig time needed to pull the running tool following use of the running tool while maintaining or increasing safety at the rig deck.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A well tool comprising:

a hanger for landing in a wellhead;

a hanger seal for sealing between the hanger and the wellhead:

a hanger running tool having a stem for securing, to a running string, a stern flow passage extending axially through the stem relative to a longitudinal axis of the stern, a body releasably connected to the hanger, and a piston releasably connected to the hanger seal, the body and the piston being axially movable relative to each other and to the stem;

a tubular receptacle sub defining a central bore having an upper end that couples to a lower end of the stem of the running tool;

a sleeve in the central bore, the sleeve selectively moveable in the central bore from an upper position to a lower position;

the sleeve having at least one bypass port extending from an exterior to an interior of the sleeve;

at least one retainer securing the sleeve in the upper position;

a sleeve seal on the sleeve above the bypass port that seals the exterior of the sleeve to the bore while the sleeve is in the upper position;

a bypass passage in the bore of the sub having an upper inlet portion and a lower outlet portion in fluid communication with the bypass port, and having a cross-sectional flow area that is at least equal to a cross-sectional flow area of the central bore;

a drop member adapted to be dropped through the running tool string and land on the sleeve, wherein the inlet portion of the bypass passage is blocked from fluid communication with the central bore by the sleeve seal when the drop member is located in the sleeve and the sleeve is in the upper position, enabling fluid to be pumped down the running string and through the stem at a first pressure level to the piston to set the hanger seal; and wherein the retainer is adapted to selectively release the sleeve in response to a second and greater pressure level in the stem flow passage so that the sleeve moves downward to the lower position, placing the bypass passage in fluid communication with the bore when the sleeve is moved to the lower position, allowing fluid communication from above the central bore through the bypass passage and the bypass port of the sleeve, enabling fluid in the running string and the stem flow passage to flow into and out the sleeve during retrieval of the running tool.

2. The well tool of claim 1, wherein:

the central bore defines an upward facing shoulder near a lower end of the central bore; and the sleeve has a downward facing shoulder spaced above the upward facing shoulder while the sleeve is in the upper portion.

3. The well tool of claim 2, wherein the sleeve further comprises:

a cylindrical protrusion extending downward from a lower end of the sleeve; and the cylindrical protrusion extends below the upward facing shoulder of the sub while the sleeve is in the upper position.

4. The well tool of claim 1, wherein:

the receptacle sub defines a stop receptacle;

at least one stop limiter is formed in a sidewall of the sleeve proximate to the stop receptacle; and the stop limiter is adapted to move axially within the stop receptacle so that axial movement of the sleeve will be limited by upper and lower shoulders of the stop receptacle.

5. The well tool of claim 1, wherein:

the receptacle sub defines a plurality of windows in a sidewall of the tubular body;

the sleeve defines a plurality of threaded holes, a threaded hole corresponding to each window; and a limiter screw threads into each threaded hole such that a head of the limiter screw will remain within a corresponding window, the limiter screw limiting movement through contact with the edges of the window.

6. The well tool of claim 1, wherein the bypass passage comprises an annular recess formed in central bore of the sub.

7. The well tool of claim 6, wherein:

while the sleeve is in the upper position and the drop member is landed on the sleeve, the sleeve seal around the sleeve blocks fluid pressure above the drop member from the annular recess; and while the sleeve is in the lower position, fluid pressure above the drop member causes fluid to flow from above the sleeve into the annular recess and from the annular recess through the bypass opening.

8. The well tool of claim 6, wherein:

the flow area at the upper end of the annular recess is greater than or equal to the flow area in the bore;

an upper portion of the annular recess comprises a conical surface extending downward and outward;

an upper end of the sleeve comprises conical surface that tapers downward and outward at a same taper angle as the upper portion of the annular recess; and the upper end of the sleeve is located below the upper portion of the annular recess while the sleeve is in the lower position.

9. The well tool of claim 1, wherein the bypass port in the sleeve extends downward and inward from the exterior of the sleeve to the interior of the sleeve.

10. The well tool of claim 1, wherein the sub has a tubular side wall that is free of any flow ports that communicate with the interior of the sleeve in both the upper and lower positions of the sleeve.

11. A method for installing a hanger within a subsea wellhead assembly, comprising:

(a) providing a running tool having a stern with a longitudinal axis and an axial passage, a body carried by the stem for selective axial movement relative to the stem, and a piston carried by the stem for selective axial movement relative to the stem and the body;

(b) connecting a receptacle sub to the stem below the body, the receptacle sub having a central bore with an annular bypass area of greater diameter than the central bore above the bypass area, a sleeve mounted in the central bore for selective axial movement, the sleeve having a side wall with at bypass port therethrough, and positioning the sleeve in an upper position;

(c) connecting an annular hanger seal to the piston, connecting the hanger to the body, connecting the stem to a running string and lowering the hanger into the wellhead assembly;

(d) dropping a drop member in the running string to land in the receptacle sub while the sleeve is in the upper position, thereby blocking fluid flow down the running string through the sleeve and through the bypass port into the sleeve;

(e) while the sleeve remains in the upper position and contains the drop member, supplying fluid pressure to an interior of the running string and to the running tool at a first pressure to cause the piston of the running tool to lower the hanger seal relative to the stem and set the hanger seal between the hanger and an interior wall of the wellhead assembly; then (f) supplying fluid pressure to the interior of the running string and the piston of the running tool at a second pressure, greater than the first pressure, to drive the sleeve to a lower position, thereby opening a fluid flow bypass around the drop member, into the annular bypass area and from the b pass area through the bypass port into the sleeve, the fluid flow bypass having a cross-sectional flow area that is equal to or greater than a cross-sectional flow area of the central bore of the receptacle sub;

(g) disengaging the running tool from the hanger and the hanger seal; and (h) retrieving the running tool and the receptacle sub with the running string while the sleeve is in the lower position, thereby draining fluid from the running string and the stem through the sleeve.

12. The method of claim 11, wherein in step (f) all of the fluid flowing into the sleeve flows out a lower end of the sleeve.

13. The method of claim 11, wherein (f) further comprises temporarily sealing the piston to the interior surface of the wellhead assembly to create a sealed void in the wellhead assembly above the hanger seal, and directing well fluid at a test pressure from the running string to the sealed void to apply fluid pressure to an upper side of the hanger seal to test the hanger seal prior to the sleeve moving to the lower position.

14. The method of claim 11, wherein step (e) further comprises rotating the stem relative to the body to align a flow port in the stem with a flow port in the body leading to the piston.

15. A system for installing casing in a subsea wellhead, the system comprising:

a casing hanger that secures to an upper end of the casing;

a casing hanger seal that seals between the casing hanger and the wellhead;

a running tool having a stem adapted to be coupled to a running string, a body coupled to the casing hanger, and a piston coupled to the casing hanger seal, the stem having a longitudinal axis and an axial stern flow passage;

a receptacle sub coupled to a lower end of the stem, the receptacle sub having an axial central bore with an annular enlarged bypass recess, a sleeve carried in the bore and having a side wall containing a bypass port, the sleeve being axially movable from an upper position to a lower position;

a drop member configured to be lowered, through the running string and landed in the sleeve while the sleeve is in the upper position, thereby blocking an interior of the sleeve and the bypass port from fluid contained in the stem flow passage;

a shear member between the sleeve and the receptacle sub that retains the sleeve in the upper position while fluid pressure at a first pressure level is applied to the stem flow passage and the piston to move the piston and the hanger seal downward into a setting position; and the shear member being releasable in response to an increase in pressure in the stem flow passage to a second pressure level, enabling the sleeve to move to the lower position, which positions the bypass port in the annular bypass area, allowing fluid in the running string and the stem flow passage to drain through the bypass port into and out of the sleeve while the running tool is being retrieved.

16. A method for installing a casing hanger within a subsea wellhead, comprising:

(a) providing a running tool having a stem with a longitudinal axis and an axial stem passage, a body carried by the stem for selective axial movement relative to the stem, and a piston carried by the stem for selective axial movement relative to the stem and the body, the piston having an annular test seal on an exterior surface;

(b) connecting a receptacle sub to the stem below the body, the receptacle sub having a central bore with an annular bypass area of greater diameter than the central bore above the bypass area, a sleeve mounted in the central bore for selective axial movement, the sleeve having a side wall with a bypass port therethrough, and positioning the sleeve in an upper position;

(c) connecting a casing hanger seal to the piston below the test seal, connecting the casing hanger to the body, connecting the stem to a running string;

(d) lowering the casing hanger into the wellhead and sealing the test seal to an interior surface of the wellhead; then (e) lowering a drop member through the running string and landing the drop member in the receptacle sub while the sleeve is in the upper position, thereby blocking fluid flow down the running string through the bypass port into the sleeve; then (f) supplying setting fluid pressure to an interior of the running string and to the stem passage to cause the piston to lower the casing hanger seal relative to the stem and set the casing hanger seal between the casing hanger and an interior wall of the wellhead; then (g) supplying test fluid pressure to the interior of the running string and the piston of the running tool and directing the test fluid pressure to a sealed chamber located between the test seal and the casing hanger seal to test whether the casing hanger seal holds the test fluid pressure while the sleeve is still in the upper position; then (h) increasing the test fluid pressure to drive the sleeve to a lower position, thereby opening a fluid flow bypass around the drop member into the annular bypass area and from the bypass area through the bypass port into the sleeve;

(i) disengaging the running tool from the hanger and the hanger seal; and (j) retrieving the running tool and the receptacle sub with the running string while the sleeve is in the lower position, thereby draining fluid from the running string and the stem through the sleeve.

* * * * *